US007708275B2

(12) United States Patent
Aoki

(10) Patent No.: US 7,708,275 B2
(45) Date of Patent: May 4, 2010

(54) PAPER MATERIALS SORTING APPARATUS

(75) Inventor: Takeshi Aoki, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 583 days.

(21) Appl. No.: 11/476,734

(22) Filed: Jun. 29, 2006

(65) Prior Publication Data

US 2007/0108108 A1 May 17, 2007

(30) Foreign Application Priority Data

Jun. 29, 2005 (JP) ..... P2005-190682

(51) Int. Cl.
*B65H 35/10* (2006.01)

(52) U.S. Cl. ..... 271/298; 209/534

(58) Field of Classification Search ..... 209/534; 194/206, 207; 271/298; 235/379, 475–577
See application file for complete search history.

(56) References Cited

U.S. PATENT DOCUMENTS 4,524,268 A * 6/1985 Fukatsu ..... 235/379
4,602,332 A * 7/1986 Hirose et al. ..... 705/43
4,747,492 A * 5/1988 Saito et al. ..... 209/534
4,787,518 A * 11/1988 Yuge et al. ..... 209/534
5,777,882 A * 7/1998 Salgado ..... 700/214
6,726,095 B2 * 4/2004 Tamura ..... 235/379
6,860,375 B2 * 3/2005 Hallowell et al. ..... 194/328
2004/0003980 A1 * 1/2004 Hallowell et al. ..... 194/206

FOREIGN PATENT DOCUMENTS

JP 2798979 B2 7/1998

* cited by examiner

*Primary Examiner*—Patrick H Mackey
*Assistant Examiner*—Jeremy Severson
(74) *Attorney, Agent, or Firm*—Pillsbury Winthrop Shaw Pittman, LLP

(57) ABSTRACT

A paper materials sorting apparatus that includes note denomination discriminating mechanism for discriminating the paper materials based on note denominations of the paper materials, cassette assignment mechanism for assigning each of a plurality of wrapping devices and/or storage devices a note denomination, and a sorting mechanism for sorting the paper materials in accordance with their note denomination and for directing the sorted paper materials to the corresponding assigned wrapping devices and/or storage devices. The sorting mechanism further contains counting mechanism for counting throughput of the sorted paper materials into each of the assigned wrapping devices and/or storage devices, comparison mechanism for comparing the throughput of each of the assigned wrapping devices and/or storage devices, and an operation display for displaying a recommended operation to reassign the note denominations of the wrapping devices and/or storage devices in order to balance the sorting load among the wrapping devices and/or storage devices.

8 Claims, 8 Drawing Sheets

PAPER MATERIALS SORTING APPARATUS

CROSS-REFERENCE TO RELATED APPLICATION

This application is based upon and claims the benefit of priority from prior Japanese Patent Application No. 2005-190682 filed on Jun. 29, 2005; the entire contents of which are incorporated herein by reference.

BACKGROUND OF THE INVENTION

1. Field of the Invention

This invention generally relates to a paper materials sorting apparatus having a sorting device that sorts paper materials, such as, for example valuable papers, by appropriately discriminating them. Further, the invention also relates to a paper materials sorting apparatus that is able to choose an appropriate storage cassette according to the throughput of the paper materials discrimination process.

2. Description of the Related Art

As shown in the Japanese Patent No. 2798979, a conventional paper materials sorting apparatus for sorting paper materials, such as valuable papers, conveys paper materials by taking out each paper material one by one at, hopefully, a constant interval. The paper materials are conveyed to a note denomination discriminating device. The note denomination discriminating device discriminates the class (hereinafter referred to as note denomination) of the paper materials, the position of the paper materials, the authenticity (authentic or counterfeit note) of the paper materials and the re-circulation conformity (i.e., the possibility of re-circulating) of the paper materials. The conventional paper materials sorting apparatus discriminates the paper materials based on these discrimination options, and distributes the paper materials to suitable processing devices, such as a paper materials paper-strip wrapping device or a storage device. At the time, notes to be wrapped with each paper-strip wrapping device, and notes to be merely stored in each storage cassette are assigned by an operator inputting a key entry in an operation display which controls the paper materials sorting apparatus. The key entry may include a touching a display screen touch-panel or conducting a mouse operation.

If the paper materials which were able to be conveyed to the paper-strip wrapping device are stored in a predetermined number of sheets, for example, 100 sheets. The set of 100 sheets are rounded and wrapped with the paper strip supplied from the paper strip reel carried in the device (see, for example, the above-mentioned Japanese Patent No. 2798979). These rounded and wrapped paper materials of 100 sheets are called a bundle.

However, in the paper materials sorting apparatus disclosed by Japanese Patent No. 2798979, the storage cassette or the paper-strip wrapping device was uniquely assigned by the operator for each note denomination. Therefore, a processing load imbalance occurs between storage cassettes and paper-strip wrapping devices that process high volume note denominations and the storage cassettes and paper-strip wrapping devices that process lower volume note denominations Since, an operator has no way of recognizing the cumulative load of each of the storage and paper-strip wrapping devices for each note denomination, it is difficult to adjust the allotment of note denominations to correct the load imbalance. Such load imbalances affect the life expectancy of different processors and ultimately compromise the overall efficiency of such apparatuses.

SUMMARY OF THE INVENTION

The embodiments disclosed herein are directed to a paper materials sorting apparatus might that measures the cumulative load of each of the storage cassettes and/or a paper wrapping devices for every operation. The paper materials sorting apparatus is also configured to notify an operator of the information for performing suitable cassette assignment for each of the storage cassettes and paper wrapping devices for the next operation.

According to the disclosed embodiments, the paper materials sorting apparatus is provided with note denomination discriminating means for taking out paper materials from a feeder and for discriminating the paper materials based on note denominations of each of the paper materials; cassette assignment means for assigning each of a plurality of wrapping devices and/or storage devices a note denomination, such that each of the wrapping devices and/or storage devices handles paper materials of the assigned note denomination and sorting means for sorting the paper materials in accordance with their note denomination as discriminated by the note denomination discriminating means and for directing the sorted paper materials, on a note denomination basis, to the corresponding assigned wrapping devices and/or storage devices. The sorting means also comprises counting means for counting throughput of the sorted paper materials into each of the assigned wrapping devices and/or storage devices, comparison means for comparing the throughput of each of the assigned wrapping devices and/or storage devices based on a result of the counting means, comparison result display means for displaying a result of the comparison means; and operation display means for displaying a recommended operation to reassign the note denominations of the wrapping devices and/or storage devices into which the sorted paper materials are directed in order to balance the sorting load among the wrapping devices and/or storage device, based on a result of the comparison means.

DETAILED DESCRIPTION OF THE INVENTION

Hereafter, the embodiments will be explained with reference to the FIGs.

First Embodiment

Figure 1:
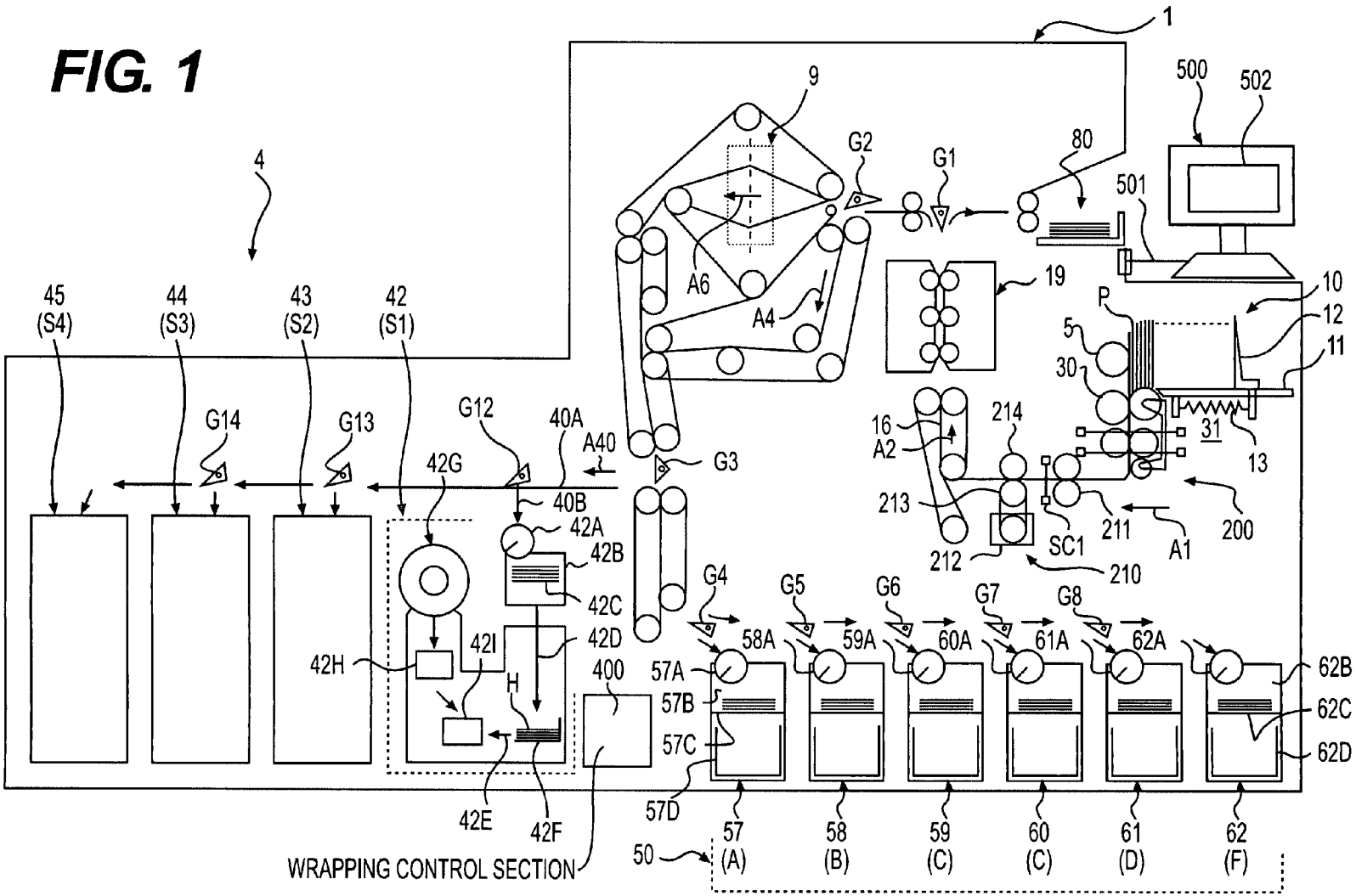
FIG. 1 is a schematic diagram of the paper materials sorting apparatus according to a first embodiment.

FIG. 1 is a schematic diagram of the paper materials sorting apparatus. The paper materials sorting apparatus, is comprised of a mechanical portion 1 and a main controller 500. By virtue of the operator engaging the operation displays (hereinafter, also referred to as operation display means) 502, several work or task operations, such as, inputting notes, organizing services, assignment of notes (hereinafter, also referred to as cassette assignment) to the paper-strip wrapping devices 42-45 and storage devices 57-62, configuring the discrimination level of notes that may be re-circulated, etc. may be set up. After the assignments, paper materials P consisting of multiple note denominations are supplied to feeder 10 and are taken out one at a time, and then conveyed to note denomination discriminating device 19. In note denomination discriminating device 19, the note denomination of each paper material P is discriminated and is then conveyed to specified paper-strip wrapping devices 42-45, or storage devices 57-62, and is stored by each cassette 57D-62D.

The amount of notes wrapped and processed by note denomination discriminating device 19 as well as deadline processing of dealings for the accumulated notes are then calculated. Balance processing which totals the number of dealings in units per day may also be performed.

A paper materials inputting operation is an operation that defines the notes that may be re-circulated as well as other notes that should not be re-circulated for every note denomination and every posture (i.e. position of notes), and checks the amount of total money counted in the paper materials sorting apparatus 1. The total amount should correspond with the total amount of money before the sorting processing, and for registering the paper materials to the sorting apparatus 1. Paper materials P are wrapped at paper-strip wrapping devices 42-45, or stored by each cassettes 57D-62D of storage devices 57-62.

Organizing service is a residual operation other than registering the count for payment operations. That is, the organizing service is an operation that counts the note denominations which are traded, but the object is not to count for payment operations etc. For example, it is a service for storing for every posture of paper materials in each cassette 57D-62D of storage devices 57-62 or a paper-strip wrapping device.

Cassette assignment is an operation that specifies the note denomination which is to be wrapped by the paper-strip wrapping devices 42-45, and stored in each of the cassettes 57D-62D of storage devices 57-62.

For example, during the paper materials receiving process, a note denomination with high volume may be assigned to a paper-strip wrapping device to perform the paper-strip wrapping operation. However, when there are seven kinds of note denominations, the paper-strip wrapping devices 42-45 may be assigned to the first four note denominations to which only four sets are connected to the paper-strip wrapping devices 42-45, and then assign the remaining three note denominations to cassettes 57D-59D of storage devices 57-59. After the paper-strip wrapping processing of the top four note denominations is completed, for the notes stored in the storage cassettes 57D-59D, the assignment of the paper-strip wrapping devices 42-45 is changed and the notes and the notes are re-taken in. Then, the paper-strip wrapping process, carrying out (organizing service) process are performed and the paper materials counter performs the number of sheets that have been retaken-in and the bundle bunch processing is performed manually.

Re-circulation conformity discrimination threshold level setting is a setting that specifies the discriminates threshold level to identify notes that should be re-circulated and notes that should not be re-circulated. Re-circulation conformity discrimination will be described in greater detail later.

Deadline processing of dealings refers to the transfer of notes in storage devices 57-62 into cassettes 57D-62D when completion operation touch panel 502 is operated. Each cassette in which paper materials are accumulated is exchanged with an empty cassette by the operator via the operation touch panel 502.

The posture (or physical position) of paper materials P will now be explained. There are four posture states of the paper materials P, i.e., a posture where the front-side is up (hereinafter, referred at as F-posture), a posture where the backside is up (hereinafter, referred to as B-posture, an erected posture (hereinafter, referred to as E-posture), an inverted posture (hereinafter, referred to as I-posture), i.e., an FE (front and erected) posture, an FI (front and back) posture, a BE (back and erected) posture and a BI (back and inverted) posture.

Returning to FIG. 1, mechanical portion 1 includes feeder 10, which supplies paper materials P, paper materials extraction device 200, which takes out one paper materials P at a time from the feeder 10, and conveyer line 16 which conveys paper materials P taken out from the paper materials extraction device 200 along the arrow A1 direction. The conveying pitch of paper materials P can be adjusted by conveying pitch compensation portion 210. Note denomination discriminating device 19 which discriminates the note denomination of paper materials P one at a time, is located along conveyer line 16. In order to adjust the posture of paper material P from among the four possible posture states, specific posture, for example, the FE-posture, posture adjusting portion 9 is adjusted. Paper materials P that are adjusted for a specific posture by posture adjusting portion 9 are stored for every note denomination in storage devices 57-62. Storage devices 57-62 and paper-strip wrapping devices 42-45 are assigned a note denomination via operation display 502.

Mechanical portion 1 is connected to main controller 500 via interface 501. Hereafter, the composition of mechanical portion 1 will be explained sequentially, beginning with feeder 10 of paper materials P.

The above-mentioned feeder 10 comprises stage 11 which contacts and carries out ready grade of the paper materials P which may have intermingled postures. Backup plate 12, arranged in the perpendicular direction to the stage 11, is movable on left-hand side along stage 11 according to the energizing force of spring 13. Thus, the supplied paper materials P are pushed by pressure to the pickup roller 5 side with backup plate 12. In the state, when take-off roller 30 rotates, paper materials P has a constant interval, is taken out one sheet at a time, and it lets it out to conveyer line 16.

Conveying pitch compensation portion 210 is provided with timing sensor SC1 that is installed in proximity to the conveying roller 211, downstream of the conveying direction, and detects paper materials P. Conveying pitch compensation portion 210 also includes conveyer roller 213, of which its rotational speed can be changed with a driving force from a conveyer roller drive motor 212 and conveying pitch control portion (not shown) which controls pinch roller 214, and conveyer roller drive motor 212.

Branching gate G1 is, for example, a gate for sorting rejected notes and notes to be processed. The rejected paper materials P are those discriminated in the discriminating device 19 as notes that should not be re-circulated, counterfeit notes, notes that cannot be discriminated due to being torn, skewed, etc. As will be described in greater detail later, a conveyor controller's receipt of the discriminated results will accumulate the rejected notes in rejection storage portion 80 by rotating branching gate G1 on right-hand side (clockwise rotation).

Processed notes refer to the paper materials that have been discriminated by the note denomination discrimination portion of note denomination discriminating device 19. If the discriminated result is received, a conveyor controller (detailed later) will rotate branching gate G1 on left-hand side (counterclockwise rotation), and will convey the paper materials in the direction which carries out discrimination processing.

Branching gate G2 is a front/back reversing branching gate. Based on the posture of paper material P discriminated by the note denomination discrimination portion, the paper material P that needs to be reversed front/back, is turned right (clockwise) and then reversed in front/back reversing portion 9 as indicated with arrow sign A6. When it is unnecessary to reverse the paper materials front/back, branching gate G2 is turned left and thus paper material P is forwarded in the direction as indicated by arrow sign A4.

Front/back reversing portion 9 reverses the front/back of paper materials P based on the result discriminated by the note denomination discrimination portion of note denomination discriminating device 19. For example, when a posture of paper material P is a BE (back erection) posture, it is reversed to the FF (front erection) posture by front/back reversing portion 9.

Branching gate G3 is a branching gate which branches paper materials P conveyed from conveyer line (main conveying passage) 16 to paper-strip wrapping devices 42-45 of paper strip wrapping portion 4, or storage devices 57-62 of storage portion 50. For cases in which the specified note denomination require that the conveyed paper materials P be stored, as designated by main controller 500, a conveyor controller rotates branching gate G3 on left-hand side (counterclockwise rotation), and distributes it so that paper materials P may be stored in storage devices 57-62 via gates G4-G8 from gate 63. In the case of which notes are designated to be wrapped, a conveyor controller rotates branching gate G3 on right-hand side (clockwise rotation), and conveys paper materials P in the direction of paper-strip wrapping devices 42-45 shown by graphic display arrow A40.

In order to sort into paper-strip wrapping devices 42-45 and storage devices 57-62 from the conveyer line by which paper materials P are conveyed, the storage devices are configured with a bladed wheel and constitute storage cassettes for storing paper materials P at the end of the conveyer line.

For example, in the case of storage cassette 57, it comprises a bladed wheel 57A, a temporary storage cassette 57B, a shutter 57*c* and a bushing (not shown) which assists in the storing operation.

The bladed wheel 57A has multiple blades mounted around the periphery of rotating shaft and rotates in synchronization with conveyance of paper materials P, so that conveyed paper materials P can be received between blades. The kinetic energy of paper materials P conveyed at high speed by using the bladed wheel 57A is absorbed and ready grade paper materials P are stored in temporary storage cassette 57B.

Temporary storage device 57B used in the storage device 57 is equipped with shutter 57C, so that paper materials P can be stored in shutter 57C. And, when the paper materials P overfill the shutter 57C or the operation termination is directed, shutter 57C opens and the paper materials P stored in shutter 57C fall down to cassette 57D below the shutter 57C, and stored therein.

In one embodiment, paper strip wrapping portion 4 comprises four paper-strip wrapping devices 42-45, which are arranged in order toward the downstream conveying direction. Since these four paper-strip wrapping devices 42-45 are similarly constituted by each, only the internal configuration of paper-strip wrapping device 42 is shown in detail.

Paper-strip wrapping device 42 comprises a bladed wheel 42A, temporary storage cassette 42B, backup plate 42C, a conveying portion, and a paper-strip wrapping portion.

The objective of temporary storage cassette 42B differs from temporary storage cassette 57B used in storage device 57. That is, for example, if the amount of paper materials P stored on backup plate 42C reaches a 100 sheets (hereinafter, referred to as 100-sheets paper materials lump H), a pusher (not shown) will descend and lump H will be stuffed into temporary storage cassette 42B of paper-strip wrapping device 42. Next, conveying carrier 42F which holds and maintains lump H with backup plate 42C and the pusher is passed.

A conveying portion comprises longitudinal conveying path 42D, conveying carrier 42F, and horizontal conveyer line 42E. Longitudinal conveying path 42D is for elevating or pulling down the 100-sheets paper materials lump H received on backup plate 42C. Conveying carrier 42F receives 100-sheets paper materials lump H from backup plate 42C in the stop position of longitudinal conveying path 42D, and in order to pass a wrapping tray (not shown), it is configured so that reciprocation moving of the horizontal conveyer line 42E top can be carried out.

A paper-strip wrapping portion is comprised of a paper strip 42G for a paper strip portion to wrap 100-sheets paper materials lump H loaded into the wrapping tray, a paper strip feeding portion 42H provided with a printing mechanism for printing the paper strip 42G and a feeding mechanism for feeding the paper strip 42G, a paper strip wrapping portion 42I for wrapping the 100-sheets paper materials lump H with the paper strip 42G fed from the paper strip feeding portion 42H and a paper strip wrapping controller 40 for controlling a paper-strip wrapping portion 4. Here, as mentioned above, wrapping devices 43-45 are constituted in a similar manner to the above-mentioned paper-strip wrapping device 42.

Figure 2:
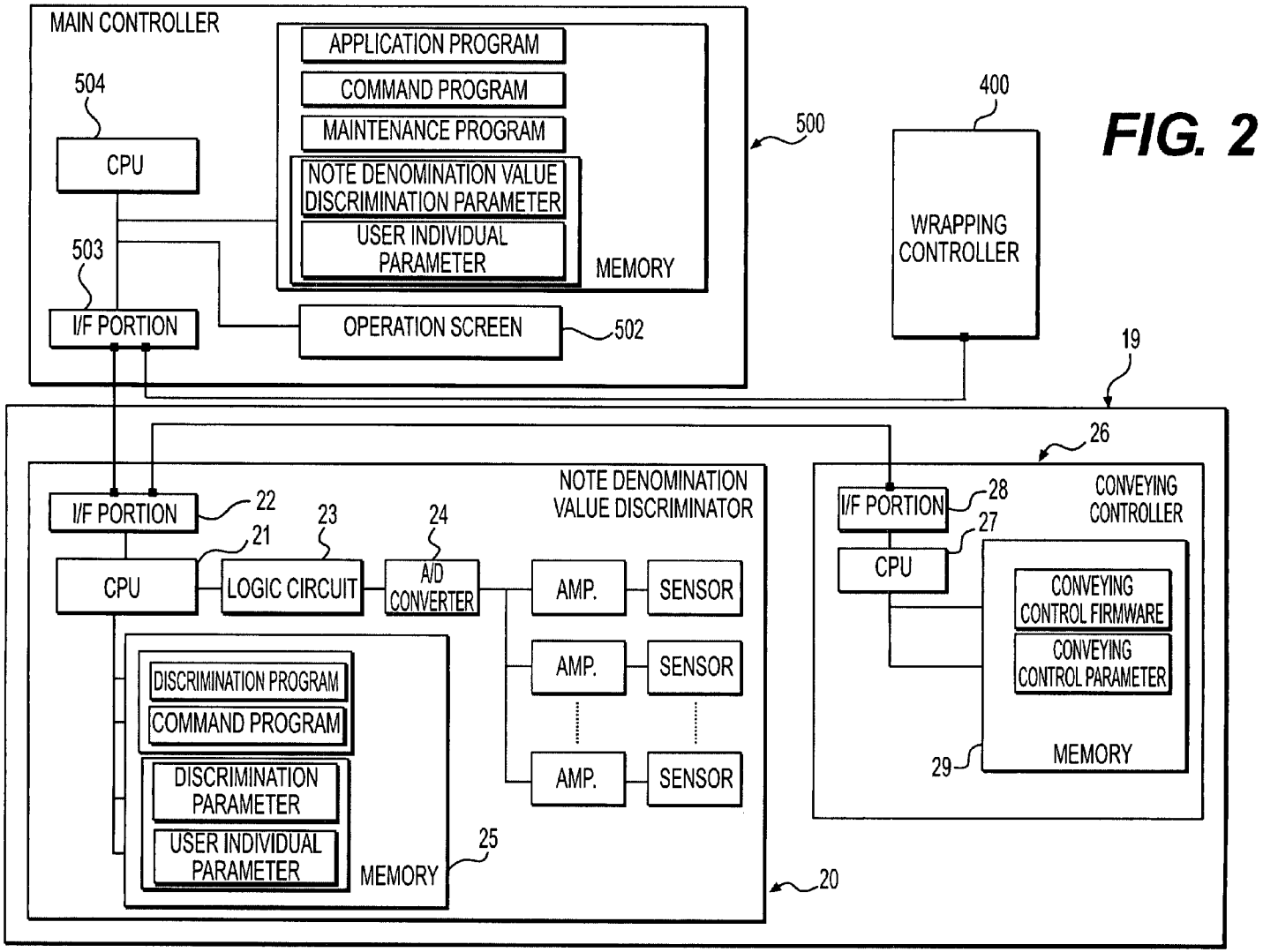
FIG. 2 is a block diagram showing the composition of a note denomination discriminating device and a main control portion.

FIG. 2 is a block diagram depicting the configuration of note denomination discriminating device 19 and main controller 500. Ticket type discriminating device 19 comprises note denomination discriminator 20 which discriminates paper materials P, and conveyor controller 26 which determines the destination of paper materials P conveyed.

Ticket type discrimination portion 20 comprises a processing means to process the output signal of amplifying circuits AP1-APn, which amplify the output signal of a multiple sensors S1-Sn that detect the optical property and magnetic property in connection with construction material of paper materials P. The processing means has an A/D converter 24 for carrying out A/D conversion, and logic circuit 23 which performs the logical operation of the data by which A/D conversion is carried out in the A/D converter 24. This processing means has a CPU 21 which controls note denomination discrimination, posture discrimination, authenticity discrimination, re-circulation conformity discrimination, and the whole note denomination discriminator 20 from the output signal of the logic circuit 23. This processing means has I/F portion 22 for communicating the result and data which were discriminated by memory 25 which is accessed CPU 21 between main control portions 500, and is constituted by CPU 21 again.

Carrier control portion (hereinafter, also referred to control means) 26 determines the destination of paper materials P according to the discriminated result of note denomination discriminator 20, and comprises CPU 27, which performs conveyance control of paper materials P, memory 29 accessed by the CPU 27, and I/F portion 28 with note denomination discriminator 20.

Conveyance control of paper materials P is carried out by conveyor controller 26 which controls by the above composition conveyance of paper materials P discriminated by note denomination discriminator 20, and wrapping controller 400 which wraps paper materials P conveyed by the conveyor controller 26.

Figure 3:
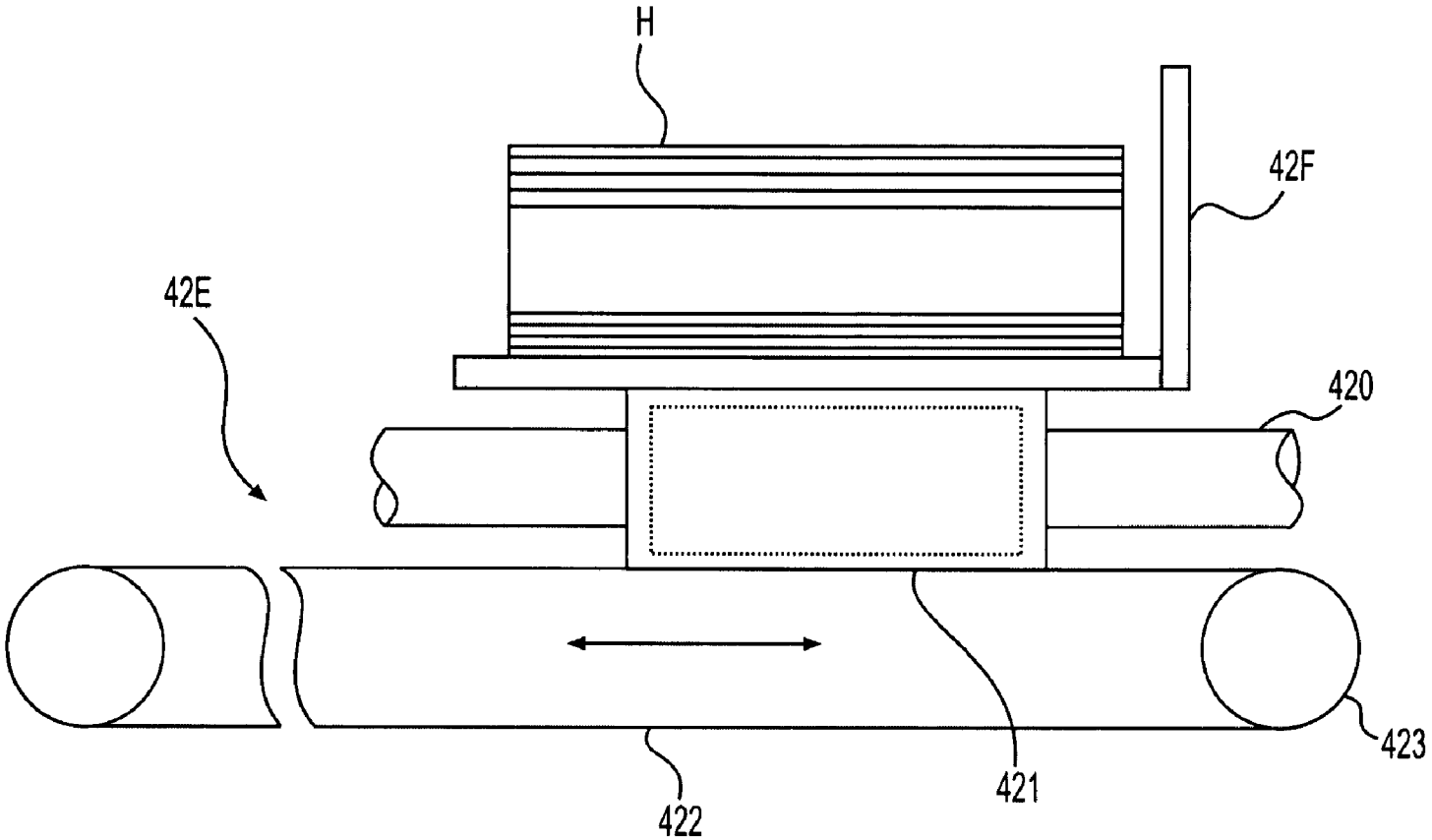
FIG. 3 is a detailed view showing the horizontal conveyer line of a conveying portion and the conveying carrier which constitutes a paper-strip wrapping device.

FIG. 3 depicts a horizontal conveyer line 42E of a conveying portion and conveying carrier 42F which constitute paper-strip wrapping device 42, for example. Conveying carrier 42F is laid on linear bushing 421. Linear bush 421 fits into linear shaft 420 located in parallel with horizontal conveyer line 42E, and moves along with linear shaft 420. The conveying carrier 42F is fixed to timing belt 422. As such, when timing belt 422 moves horizontal conveyer line 42E with a drive motor (not shown), conveying carrier 42F is guided by linear shaft 420 and moves. The above-mentioned linear bushing 421 absorbs the vibration when carrying out transverse movement by predetermined number of sheets, for example, the state where paper materials H of 100 sheets was loaded, has a percolating function.

In order to go and come back to linear bushing 421 one time for every strip-wrapping operation, in the case of the paper-strip wrapping device of a note denomination with many throughputs of paper materials, damage by friction of the above-mentioned sliding portion becomes large, and a life becomes short.

Usually, for example, when the paper materials of a multiple note denominations is processed, there is a large difference in the re-circulation ratio for every note denomination, and a big difference arises in the throughput which a paper materials sorting apparatus processes according to the ratio. Therefore, if a note denomination is fixed for every paper-strip wrapping device, the life expectancy of the wrapping device components differ according to their throughput.

Figure 4:
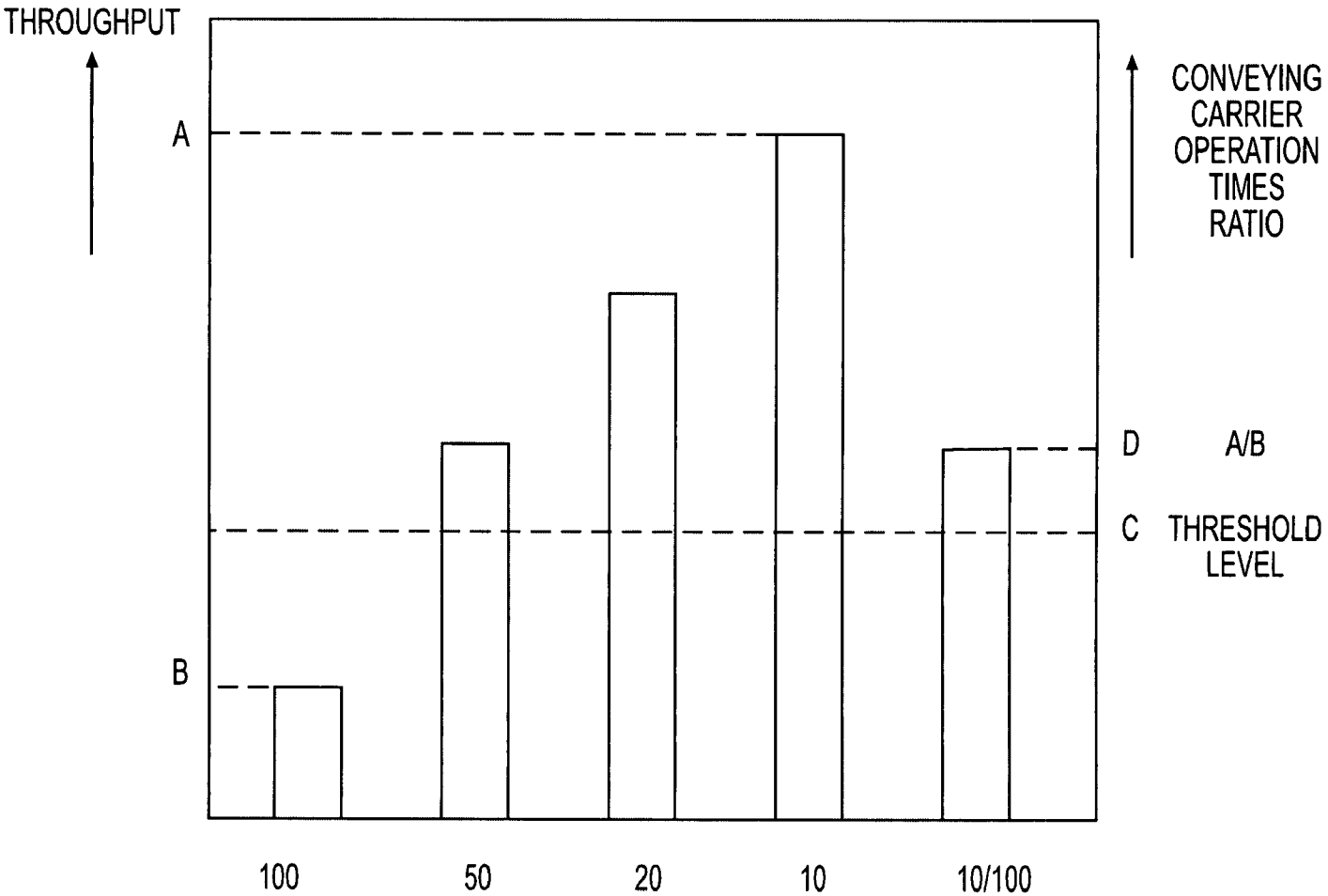
FIG. 4 is a bar graph showing the throughput according to note denomination and conveying carrier operation frequency ratio per unit time.

FIG. 4 is a graph depicting the throughput according to note denomination and conveying carrier operation frequency ratio (namely, ratio of wrapping number of times) per unit time. The vertical axis on the left of the graph indicates throughput, and the horizontal axis indicates each note denomination.

Further, the vertical axis on the right indicates a conveying carrier operation frequency ratio. Hereafter, with reference to the graph of FIG. 4, the leveling means of the mechanical load of a paper-strip wrapping device will be explained.

FIG. 4 provides an example for calculating a ratio of the least throughputs (processed amount) of notes and the largest throughputs (processed amount) of notes among four classes of notes, e.g., 100-denomination notes, 50-denomination notes, 20-denomination notes, and 10-denomination notes. Here, throughput means the number of times which wrapped 100-sheets paper materials lump H form the bundle. Therefore, the throughput and a carrier operation frequency become the same value. As indicated in the graph of FIG. 4, the throughput of most note denominations is A with 10-denomination notes, and the throughput of the fewest note denominations are 100-denomination notes is B. Carrier operation frequency ratio D at that time is shown by the following equation (1):

$$D=A/B \tag{1}$$

where,

A: the throughput of the most (e.g., 10-denomination) notes; and

B: the throughput of the fewest (e.g., 100-denomination) notes.

Next, a comparison is made with threshold level C which determines the right or wrong exchange of conveying carrier operation frequency ratio D obtained by the equation (1), as shown in following equation (2):

$$D>C \tag{2}$$

Since imbalance of the throughputs occurs when carrier operation frequency D exceeds the above-mentioned threshold level C, the recommendation cassette assignment to the next operation is displayed, and an operator is notified.

Figure 5:
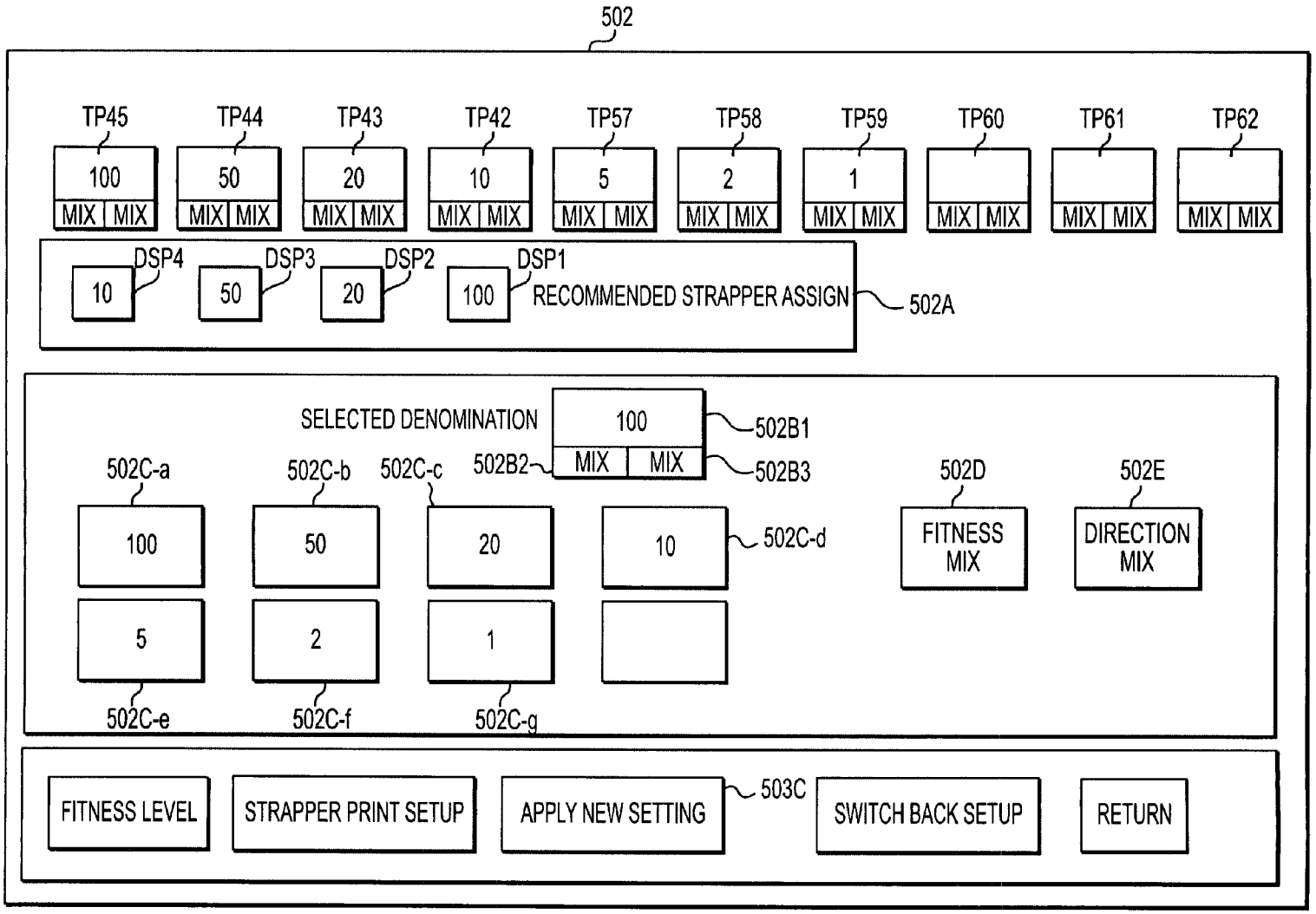
FIG. 5 depicts an operation screen according to the first embodiment.

FIG. 5 shows the operation screen according to the first embodiment of the present invention, and is an example in the case of notifying an operator of a recommended cassette assignment, based on conveying carrier operation frequency ratio D, as shown in FIG. 4. The example which notifies recommendation cassette assignment will be explained also referring to the paper materials sorting apparatus of FIG. 1. Corresponding to paper-strip wrapping devices (hereinafter, also referred to as wrapping means) 42-45, touch panels TP42-TP45 are formed in operation screen (hereinafter, also referred to as operation display means) 502, and touch panels TP57-TP62 are formed in it corresponding to storage cassettes (hereinafter, also called storage means) 57-62. Here, the discrimination of note denomination will be explained assuming the processing of 1-denomination notes, 2-denomination notes, 5-denomination notes, 10-denomination notes, 20-denomination notes, 50-denomination notes, and 100 denomination notes.

First, based on the cassette assignment means (to be discussed in greater detail below), the cassette assignment of paper-strip wrapping devices 42-45 and storage devices 57-62 is performed from operation screen 502. As one example, by assigning 100-denomination note to touch-panel TP42, 20-denomination note to touch-panel TP43, 50-denomination note to touch-panel TP44, and 100-denomination note to touch-panel TP45, provides the cassette assignments of paper-strip wrapping devices 42-45. Further, cassette assignments of storage devices 57-59 are performed by assigning 5-denomination notes to touch-panel TP57, 2-denomination notes to touch-panel TP58, 1-denomination notes to touch-panel TP59. Storage devices 60-62 are not note denomination specified, as this example illustrates the case where an operator is notified with the application of recommendation cassette assignment at a paper-strip wrapping device.

Next, the predetermined dealings operation are performed based on the above-mentioned cassette assignment and, after the dealings are performed, balance processing, which totals the number of dealings, is performed.

In connection with the termination of the above-mentioned balance processing, when the trading volume of the paper-strip wrapping device per unit time, as shown in FIG. 4 is obtained, that is, when conveying carrier operation frequency ratio D given by equation (1) satisfies equation (2), it turns out that the throughput of paper-strip wrapping device 42 which wraps 10-denomination notes is more than the throughput of paper-strip wrapping device 45 which wraps 100-denomination notes. As such, the predetermined threshold level C has been exceeded and load unbalance has occurred.

In such a case, main controller 500 displays the recommendation cassette assignment at the time of the next operation on Recommended Strapper Assignment (RSA) of cassette assignment to paper-strip wrapping device or storage cassette. That is, the recommendation is provided to indication area 502A of operation screen (operation display means) 502. Another touch panel (also referred to as input means) is set to the operation screen 502, so that instructions can be input by selectively touching various touch panels. Although it is also possible to use the mouse connected to CPU 504 of main controller 500 and a keyboard (not shown), the example is directed to the case where a touch panel is used as an input means.

Here, to exchange the assignment of paper-strip wrapping devices between 10-denomination notes, having a high throughput, and 100-denomination notes, having a low throughput, the cassette assignment of 100-denomination note is displayed on the display area DSP1 of the RSA display 502A, and displays the cassette assignment on the display area DSP4 to recommend the cassette assignment of the 10-denomination note. On the other hand, the note denomination of viewing-area DSP2 and viewing-area DSP3 displays the cassette assignment directions left intact.

Next, the cassette assignment resetting means to change the direction of the 100-denomination notes and 10-denomination notes currently displayed in viewing-area DSP1 will be explained.

First, the 100-denomination notes are assigned by touching note denomination setting touch-panel 502C-a. At the time, the numeric value "100" indicating 100-denomination note is displayed on note denomination indication touch panel 502B.

Regarding the re-circulation of notes, the re-circulation and disqualification of the note denominations is displayed on re-circulation accurate and disqualified indication touch-panel 502B-2, and is set by the re-circulation accurate and disqualified indication change touch panel 502D. That is, whenever the re-circulation accurate/in-accurate display switching touch panel 502D is touched, notes to be re-circulated as a number of sheets (Fit), re-circulation inaccurate number of sheets (Unfit), and the mixture number of sheets (Mix) of both, are displayed on that screen in order. Mixture number of sheets is displayed in the illustrated example.

The posture of paper materials P is displayed on posture indication touch panel 502B3, and is set by the posture change touch panel 502E. That is, whenever the posture change touch panel 502E is touched, FE (front erection) posture, FI (front and inverted) posture, BE (back and erected) posture, BI (back and inverted) posture, and Mix (mixture of two or more of FF posture, FR-posture, BF-posture and BR-posture) are switched in order. The illustrated example shows the case where it is switched and set as Mix. The note denomination indication touch panel 502B1 and the touch-panel 502B-2 which display a note denomination, and the posture indication note to be re-circulated and re-circulation inaccurate indication touch panel 502B3 which assign a posture are independently, respectively, and a paper-strip wrapping device and an storage cassette are able to be arbitrarily assigned. FIG. 5 shows the state.

Next, the note denomination set as the note denomination setting touch-panel 502C-a-502C-g is specified for a predetermined paper-strip wrapping device. For example, in the case of 10-denomination notes, such a designation is input by touching the input touch-panel TP42 (portion as which numerical "10" is displayed). The content of note denomination indication touch panel 502B1, note to be re-circulated and re-circulation inaccurate indication touch-panel 502B-2, and posture indication touch panel 502B3 is displayed on the field to which touch-panel TP42 corresponds, as a result of the touch input. The 10-denomination note is set as touch-panel TP42 is changed into 100-denomination notes. Next, the setting of the 100-denomination notes for touch-panel TP45 is similar to the procedure in the case of changing into 100-denomination notes 10-denomination notes set as touch-panel TP42 mentioned above.

Next, if all the note denomination changes are completed, cassette assignment execution touch panel (Apply New Setting) 503C will be touched, and the cassette assignments will be performed. The specified note denomination for each device can be changed by the above operation.

As mentioned above, according to the first embodiment, an operator can be notified of the recommendation to change the cassette assignment for the next dealings/operation by measuring the cumulative load of a paper-strip wrapping device. If an operator performs cassette assignment based on the recommended information, it is possible to level the load of the processors, so that a specific processor does not expire prematurely.

Second Embodiment

Figure 6:
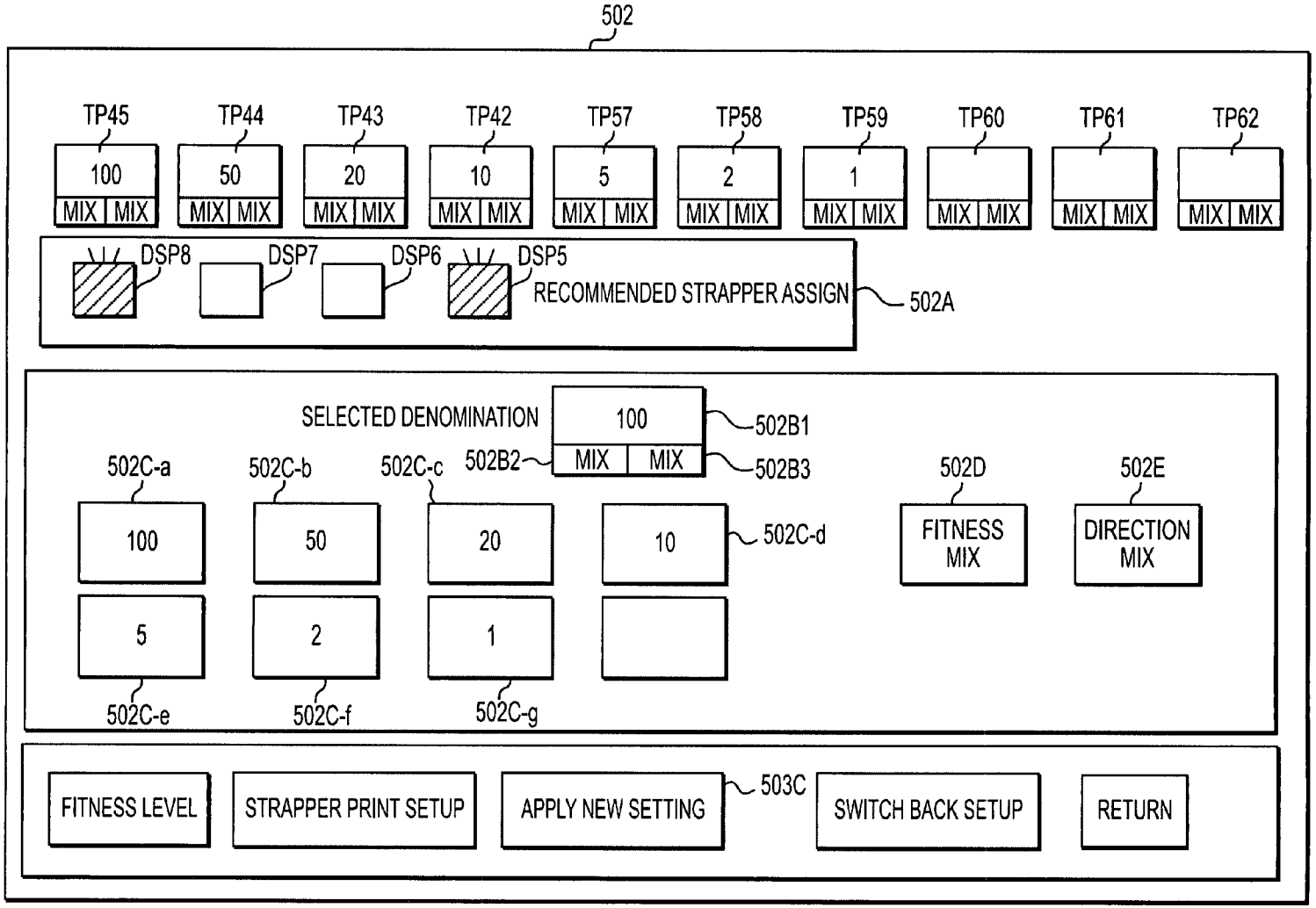
FIG. 6 depicts an operation screen according to a second embodiment.

FIG. 6 shows the operation screen of a second embodiment, and is an example of notifying the operator of recommendation cassette information based on the conveying carrier operation frequency ratio shown in FIG. 4. Since the composition of example 2 is the same as the composition of the paper materials sorting apparatus, as explained in FIGS. 1 to 4 of the first embodiment, detailed explanation is omitted. Also, since the portion except RSA indication area 502A of operation screen 502 shown in FIG. 6 is the same as that of the first embodiment shown in FIG. 5, identical codes are associated with identical portions, only a different portion will be explained. Corresponding to touch panels TP42-TP45, four viewing areas DSP1-DSP4 are formed in RSA indication area 502A, and the brightness or foreground color is changed for these four viewing areas DSP 5 to DSP 8 according to a throughput. For example, the brightness may be made low when the throughput is low, and as throughput increases, the brightness can be increased. In addition, a "safe" color may be used (e.g., green or blue) to indicate satisfactory throughput while a "dangerous" color (e.g., red) may be used for unsatisfactory throughputs.

Next, an example based on the second embodiment will be explained. First, the cassette assignment of paper-strip wrapping devices 42-45 and storage devices 57-62 is performed from operation screen 502, in similar fashion to the first embodiment shown in FIG. 5. In the cassette assignment, similar to first embodiment, the 10-denomination notes are assigned to touch-panel TP42, the 20-denomination notes are assigned to touch-panel TP43, the 50-denomination notes are assigned to touch-panel TP44, and the 100-denomination notes are assigned to the touch-panel TP45. Similarly, the 1-denomination notes are assigned to the touch-panel TP57, the 2-denomination notes are assigned to the touch panel TP58, and the 5-denomination notes are assigned to the touch-panel TP59. The cassette assignment at the time is shown in the drawing.

Next, predetermined dealings operation is performed based on the above-mentioned cassette assignment, and afterwards, balance processing which totals the number of dealings is performed.

In connection with the end of the above-mentioned balance processing, the balance judging of the throughput according to note denomination per unit time regarding the paper-strip wrapping device of the above-mentioned dealings operation is performed. For example, in the case of bar graphs shown in FIG. 4 indicating the throughput of every note denomination per unit time, i.e., conveying carrier operation frequency ratio D given by equation (1) satisfies equation (2), it is seen that the throughput of paper-strip wrapping device 42 which processes 10-denomination notes is more than the throughput of paper-strip wrapping device 45 which processes 100-denomination notes. As such the predetermined threshold has been exceeded, indicating that load unbalance has occurred.

In response, the color which was assigned as the foreground color of viewing areas DSP5-DSP8 of RSA indication area 502A is displayed according to the throughput of each note denomination. In order to notify the operator of the recommendation to exchange the assignment of the 10-denomination notes and 100-denomination notes, a recommendation cassette assignment may blink and display the recommendation at the time of the next dealings/operations.

In response to these indications, as explained in the first embodiment, the operator may change the assignments of 100-denomination notes and 10-denomination notes via touch-panel TP42 and change the assignment of 10-denomination notes and 100-denomination notes via touch-panel TP46. If necessary, a re-circulation accurate numeral and an inaccurate numeral for notes to be re-circulated/not re-circulated may be assigned through indication touch panel 502D, and note postures may be assigned through posture change touch panel 502E. In the illustrated example, re-circulation accurate, disqualified number of sheets (Fitness), and posture show the case where (Mix) is assigned.

As mentioned above, according to the second embodiment, an operator can be notified of the recommended information for the cassette assignment for the next dealings by measuring the cumulative load of a paper-strip wrapping device, similar to first embodiment. If an operator performs cassette assignment based on the recommendation, leveling of the load of a processor is attained.

According to example 2, the load balancing effect mentioned above can be achieved, by simply displaying and notifying the operator of which processors should be exchanged.

Third Embodiment

Figure 7:
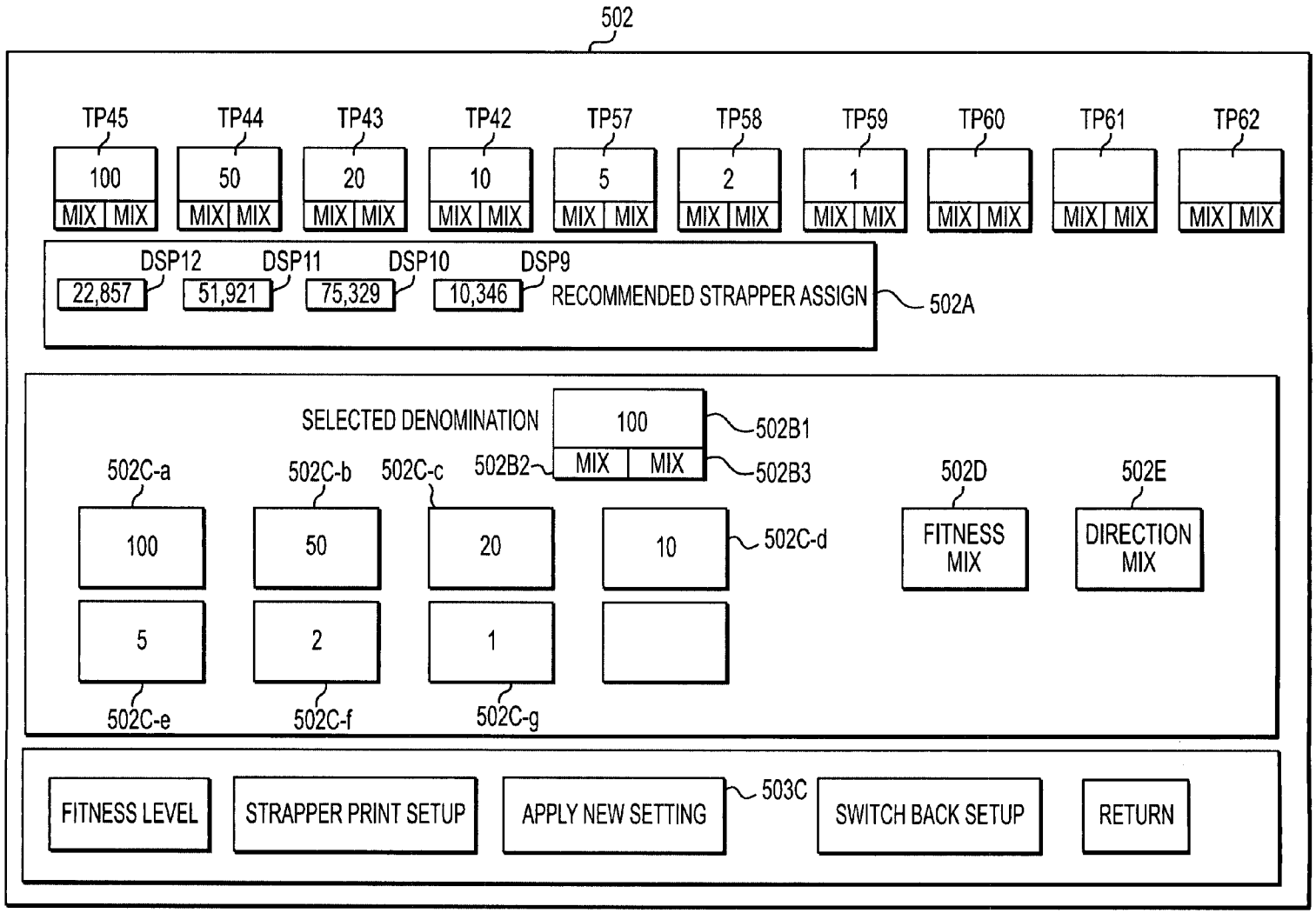
FIG. 7 depicts an operation screen according to a third embodiment.
Figure 8:
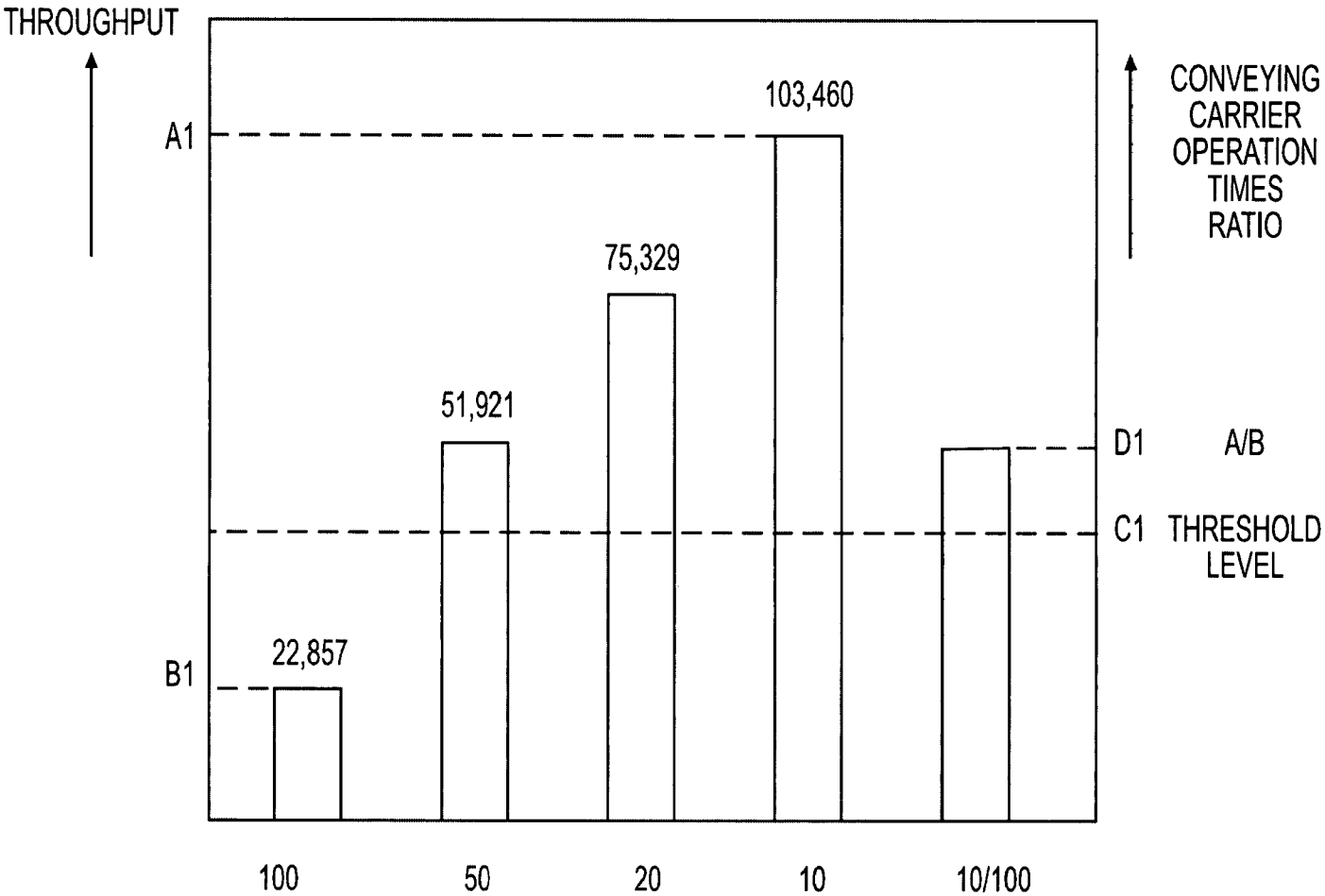
FIG. 8 depicts a bar graph with which the processed number of notes discriminated by note denomination, and a processed number-of-sheets operation ratio.

FIG. 7 shows the operation screen in accordance with a third embodiment, and is an example in the case of notifying an operator of a recommendation cassette based on the processed number of notes discriminated by note denomination and processed number-of-sheets ratio, which are shown in FIG. 8. Since the composition of the example 3 is the same as the composition of the paper materials sorting apparatus explained in FIGS. 1-4 of first embodiment, detailed explanation is omitted. Since the portion except RSA indication area 502A of operation screen 502 shown in FIG. 7 is the same as that of the first embodiment shown in FIG. 5, identical codes are attached to identical portions, only a different portion will be explained. Corresponding to touch panels TP42-TP45, 12 copies of four viewing areas DSP9-DSP are formed in RSA indication area 502A, and the number of processed sheets is displayed on these four viewing areas DSP9-DSP12.

Next, cassette assignment of paper-strip wrapping devices 42-45 and storage devices 57-62 is performed from operation screen 502 in similar fashion to the first embodiment shown in FIG. 5. That is, to touch-panel TP42, 10-denomination note is assigned; to touch-panel TP43, 20-denomination note is assigned; to touch-panel TP44, 50-denomination note is assigned; and 100-denomination note is assigned to touch-panel TP45. In addition, one-denomination note is similarly assigned to touch-panel TP57, two-denomination note and five-denomination note are assigned to touch-panel TP59 and touch-panel TP58. The cassette assignment at the time is shown in the drawing.

Next, predetermined dealings operation is performed based on the above-mentioned cassette assignment, and balance processing which totals the number of dealings is performed.

Next, in connection with the above-mentioned balance processing end, main controller 500 displays the number of processed sheets for each note denomination in each viewing area corresponding to a note denomination of RSA indication area 502A, and judges the imbalance of the number of processed sheets between paper-strip wrapping devices.

For example, in the case of the example shown in FIG. 8, it can judge by using processed number-of-sheets ratio D1 given with the following equation (3):

$$D1=A1/B1 \tag{3}$$

where,

A1: number of most processed sheets (e.g., 10-denomination);

B1: number of least processed sheets (e.g., 100-denomination).

Next, the processed number-of-sheets ratio D1 of equation (3) is compared with a predetermined threshold level C1. This relation is shown in following equation (4):

$$D1>C1 \tag{4}$$

That is, when processed number-of-sheets ratio D1 given by equation (3) satisfies equation (4), it means that the processed number of sheets of paper-strip wrapping device 42, which processes 10-denomination notes, is greater than the processed number of sheets of paper-strip wrapping device 45, which processes 100-denomination notes. As such, the predetermined threshold has been exceeded indicating that load imbalance has occurred.

In such a case, main controller 500 notifies the operator by displaying the recommended cassette, by blinking or similar means, indicating that the 10-denomination notes and 100-denomination notes should be exchanged at the time of the next dealings. Although FIG. 8 is directed to the processed number of sheets, the processed number of sheets and the number of processing are proportionally related. The number of processing may indicate the number of created bundles.

When the operator responds to the processed number of sheets, it exchanges the processor of 10-denomination notes with much processed number of sheets, and the processor of 100-denomination notes with little processed number of sheets. Like the first embodiment, the 10-denomination notes assigned to touch-panel TP42 can be changed into 100-denomination notes, and 100-denomination notes assigned to touch-panel TP45 can be changed into 10-denomination notes. If necessary, a re-circulation accurate number and a disqualified numeral may be assigned using re-circulation accurate and disqualified indication change touch panel 502D, a and note postures may be assigned through posture change touch panel 502E. In the illustrated example, re-circulation accurate, disqualified number of sheets (Fitness), and posture show the case where (Mix) is assigned.

The operating period for measuring the processed number of sheets can be arbitrarily assigned for every component which constitutes a paper materials sorting apparatus according to the throughput of a paper materials sorting apparatus.

According to the disclosed configuration, the paper materials sorting apparatus is capable of notifying operator of the information for the cassette assignment for the next dealings by measuring the cumulative load of a processor.

As mentioned above, according to the third embodiment, the operator can be notified of the information for the cassette assignment in the next operation by measuring the cumulative load of a paper-strip wrapping device, much like the first and second embodiments. If an operator performs cassette assignment based on the recommendation, leveling of the load of a processor is attained. In the example 3, since the processed number of sheets of a processor is displayed as a cumulative load, leveling of a more precise load is attained.

Further, needless to say, the invention is not restricted to the embodiment described above but is applicable by variously modifying without departing from the spirit and the scope of the invention.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A paper materials sorting apparatus, comprising:

note denomination discriminating means for taking out paper materials from a feeder and for discriminating the paper materials based on note denominations of each of the paper materials;

cassette assignment means for assigning each of a plurality of wrapping devices and/or storage devices a note denomination, such that each of the wrapping devices and/or storage devices handles paper materials of the assigned note denomination;

sorting means for sorting the paper materials in accordance with their note denomination as discriminated by the note denomination discriminating means and for directing the sorted paper materials, on a note denomination basis, to the corresponding assigned wrapping devices and/or storage devices, wherein, the sorting means comprises:

counting means for counting throughput of the sorted paper materials into each of the assigned wrapping devices and/or storage devices, comparison means for comparing the throughput of each of the assigned wrapping devices and/or storage devices based on a result of the counting means, comparison result display means for displaying a result of the comparison means; and operation display means for displaying a recommended operation to reassign the note denominations of the wrapping devices and/or storage devices into which the sorted paper materials are directed in order to balance the sorting load among the wrapping devices and/or storage device, based on a result of the comparison means.

2. The paper materials sorting apparatus according to claim 1, wherein, the cassette assignment means is provided with input means for selectively inputting an indication of an option to re-circulate and/or re-position the paper materials to be processed in the sorting means relative to their note denomination, multiple indication areas for the sorting means for displaying an operating state for each of the assigned wrapping devices and/or storage devices, and the comparison result display means is provided with a multiple indication areas corresponding to each of the assigned wrapping devices and/or storage devices.

3. The paper materials sorting apparatus according to claim 1, wherein the recommended operation to reassign the note denominations of the wrapping devices and/or storage devices is initiated when a ratio between a maximum throughput of one of the wrapping devices and/or storage devices and a minimum throughput of another of the wrapping devices and/or storage devices exceeds a predetermined threshold.

4. The paper materials sorting apparatus according to claim 3, wherein a foreground color displayed on the operation display is changed when the ratio exceeds the predetermined threshold.

5. The paper materials sorting apparatus according to claim 3, wherein in response to selecting, via an input means of the operation display means, the recommended operation to reassign the note denominations of the wrapping devices and/or storage devices, the cassette assignment means reassigns the wrapping devices and/or storage devices and the sorting means redirects the sorted paper materials to the reassigned wrapping devices and/or storage device to balance the sorting load.

6. A paper materials sorting apparatus, comprising:

a note denomination discriminating device configured to discriminate paper materials based on note denominations of each of the paper materials;

a cassette assignment mechanism configured to assign each of a plurality of wrapping devices and/or storage devices a note denomination, such that each of the wrapping devices and/or storage devices handles paper materials of the assigned note denomination;

a sorting mechanism configured to sort the paper materials in accordance with their note denomination as discriminated by the note denomination discriminating device and to direct the sorted paper materials, on a note denomination basis, to the corresponding assigned wrapping devices and/or storage devices, wherein, the sorting mechanism comprises:

a counting device that counts throughput of the sorted paper materials into each of the assigned wrapping devices and/or storage devices, a comparison device configured to compare the throughput of each of the assigned wrapping devices and/or storage devices based on a result of the counting device, and an operation display device that displays a recommended operation to reassign the note denominations of the wrapping devices and/or storage devices into which the sorted paper materials are directed in order to balance the sorting load among the wrapping devices and/or storage device, based on a result of the comparison device.

7. The paper materials sorting apparatus according to claim 6, wherein the recommended operation to reassign the note denominations of the wrapping devices and/or storage devices is initiated when a ratio between a maximum throughput of one of the wrapping devices and/or storage devices and a minimum throughput of another of the wrapping devices and/or storage devices, exceeds a predetermined threshold.

8. The paper materials sorting apparatus according to claim 7, wherein in response to selecting, via an input of the operation display device, the recommended operation to reassign the note denominations of the wrapping devices and/or storage devices, the cassette assignment means reassigns the wrapping devices and/or storage devices and the sorting mechanism redirects the sorted paper materials to the reassigned wrapping devices and/or storage device to balance the sorting load.

* * * * *